US007544077B1

(12) United States Patent
Martin et al.

(10) Patent No.: US 7,544,077 B1
(45) Date of Patent: Jun. 9, 2009

(54) CONTROL DEVICE FOR A POWER DISTRIBUTION SYSTEM

(75) Inventors: Ralph Sykes Martin, Mount Airy, NC (US); Clifford F. Lincoln, III, Atlanta, GA (US); Sarah Jean Jones, Oxford, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/028,674

(22) Filed: Feb. 8, 2008

(51) Int. Cl.
*H01R 4/60* (2006.01)

(52) U.S. Cl. ..... 439/215; 200/16 R

(58) Field of Classification Search ..... 439/49, 439/189, 215, 216, 217; 200/16 R, 51.09
See application file for complete search history.

(56) References Cited

U.S. PATENT DOCUMENTS 5,073,120 A 12/1991 Lincoln et al.
5,368,490 A 11/1994 McKissick
6,663,435 B2 12/2003 Lincoln, III et al.

*Primary Examiner*—Khiem Nguyen

(57) ABSTRACT

A power distribution system includes a plurality of circuits each configured to supply power, wherein the power distribution system includes a plurality of power modules. A first power control device is connected to each of the circuits and is configured to supply power to a first sub-set of the power modules from a first of the circuits. A second power control device is connected to each of the circuits and is configured to supply power to a second sub-set of the power modules that is different than the first sub-set of power modules. The second power control device is configured to supply power from a second of the circuits.

20 Claims, 6 Drawing Sheets

CONTROL DEVICE FOR A POWER DISTRIBUTION SYSTEM

BACKGROUND OF THE INVENTION

The subject matter herein relates generally to power distribution systems, and more particularly, to a load balancing power control device for power distribution systems.

Power distribution systems are provided for a variety of applications, such as for distributing power to receptacle outlets or for distributing power to lighting fixtures, and the like. Some power distribution systems are well suited for modular applications in which load balancing on the circuits powering the components of the system may be provided. One such conventional application is the power strip shown in U.S. Pat. No. 6,663,435, herein incorporated by reference in its entirety. The power strip described therein includes different versions of receptacle outlets that can be plugged into a tap socket assembly to connect different receptacle outlets to different line conductors and therefore different branch circuits.

Such conventional systems utilize many different receptacle outlets. When a circuit is overloaded, the receptacle outlets are replaced by different receptacle outlets that connect to different line conductors. Additionally, when rearranging the configuration of receptacle outlets, the power cable supplying power to the power strip needs to be unplugged to allow the technician to handle the receptacle outlets and avoid being shocked. Such rearranging to rebalance the loads on the circuits may be time consuming. Similar reconfiguration problems and dangerous conditions are faced by technicians in conventional power distribution systems for lighting fixtures.

A need remains for a power distribution system that controls the loads on the circuits of the system in a cost effective and reliable manner. Additionally, a need remains for a power distribution system that controls the loads in a safe manner for technicians working with the system.

BRIEF DESCRIPTION OF THE INVENTION

In one embodiment, a power distribution system is provided having a plurality of circuits each configured to supply power, wherein the power distribution system includes a plurality of power modules. A first power control device is connected to each of the circuits and is configured to supply power to a first sub-set of the power modules from a first of the circuits. A second power control device is connected to each of the circuits and is configured to supply power to a second sub-set of the power modules that is different than the first sub-set of power modules. The second power control device is configured to supply power from a second of the circuits.

Optionally, the first power control device may include a first switch operable to create a first path between the first sub-set of power modules and the first circuit, and the second power control device may include a second switch operable to create a second path between the second sub-set of power modules and the second circuit. The first power control device may include a plurality of line conductors and a switch mated with a first of the line conductors associated with the first circuit. The switch may be movable between multiple positions for mating with different ones of the line conductors so that the first sub-set of power modules can be connected to any one of the circuits depending on the position of the switch. Optionally, a third power control device may connected to each of the circuits and may be configured to supply power to a third sub-set of the power modules, wherein the third power control device is selectively connectable to either the first circuit or the second circuit depending on the load on the respective first and second circuits from the first and second power control devices to balance loads on the first and second circuits.

Optionally, the first power control device may be directly coupled to at least one of the power modules within the first sub-set of power modules. The first power control device may include a first electrical connector and a second electrical connector, wherein the first electrical connector receives a mating connector of a power distribution cable connected to the power supply, and the second electrical connector receives a mating connector of a power distribution cable connected to one of the power modules of the first sub-set of power modules. The first power control device may include a bus bar configured to supply power to the first sub-set of power modules.

In another embodiment, a power control device for a power distribution system is provided that includes a housing, a power contact held within the housing, and a distribution component having a plurality of separate line conductors. Each line conductor is configured to receive power from a different power supply circuit and each line conductor has a mating interface. The power control device also includes a movable switch having a switch contact coupled thereto. The switch contact has a first mating end electrically connected to the power contact and a second mating end selectably connected to the mating interface of one of the line conductors to define a power circuit between the power contact and one of the line conductors.

Optionally, the switch may be slidable along, or rotatable about, an axis between a first position, a second position and a third position, wherein the switch contact engages a first line conductor in the first position, the switch contact engages a second line conductor in the second position, and the switch contact does not engage any line conductor in the third position. The switch may be movable between multiple positions such that the switch contact engages different line conductors in each position and the switch contact engages the power contact in each position. Optionally, the switch contact may have a beam and a domed portion at the second mating end, wherein the domed portion engages the mating interface. The distribution component may include either a printed circuit board with traces defining the line conductors or a leadframe being held by a dielectric body. Optionally, an insulator may be positioned between the distribution component and the switch contact, wherein the insulator provides access to the mating interfaces of each of the line conductors. The switch may be movable to an off position in which power is not conducted to the power contact, and the power control device may have a safety feature configured to keep the power control device in the non-conducting state.

In a further embodiment, a power control device for a power distribution system is provided that includes a housing, a power contact held within the housing, and a distribution component having a plurality of separate line conductors. Each line conductor is configured to receive power from a different power supply circuit and each line conductor has a mating interface. The power control device also includes a movable switch having a switch contact coupled thereto. The switch contact has a first mating end electrically connected to the power contact, and the switch has a second mating end. The switch is movable between a non-conducting position and a plurality of conductive positions that are connected to the mating interface of certain ones of the line conductors. The power control device further includes a safety feature configured to keep the power control device in the non-conducting state. Optionally, the safety feature may be either a portion of the switch that is removable from the power control device or a locking feature that is configured to retain the switch in the non-conducting position.

DETAILED DESCRIPTION OF THE INVENTION

Figure 1:
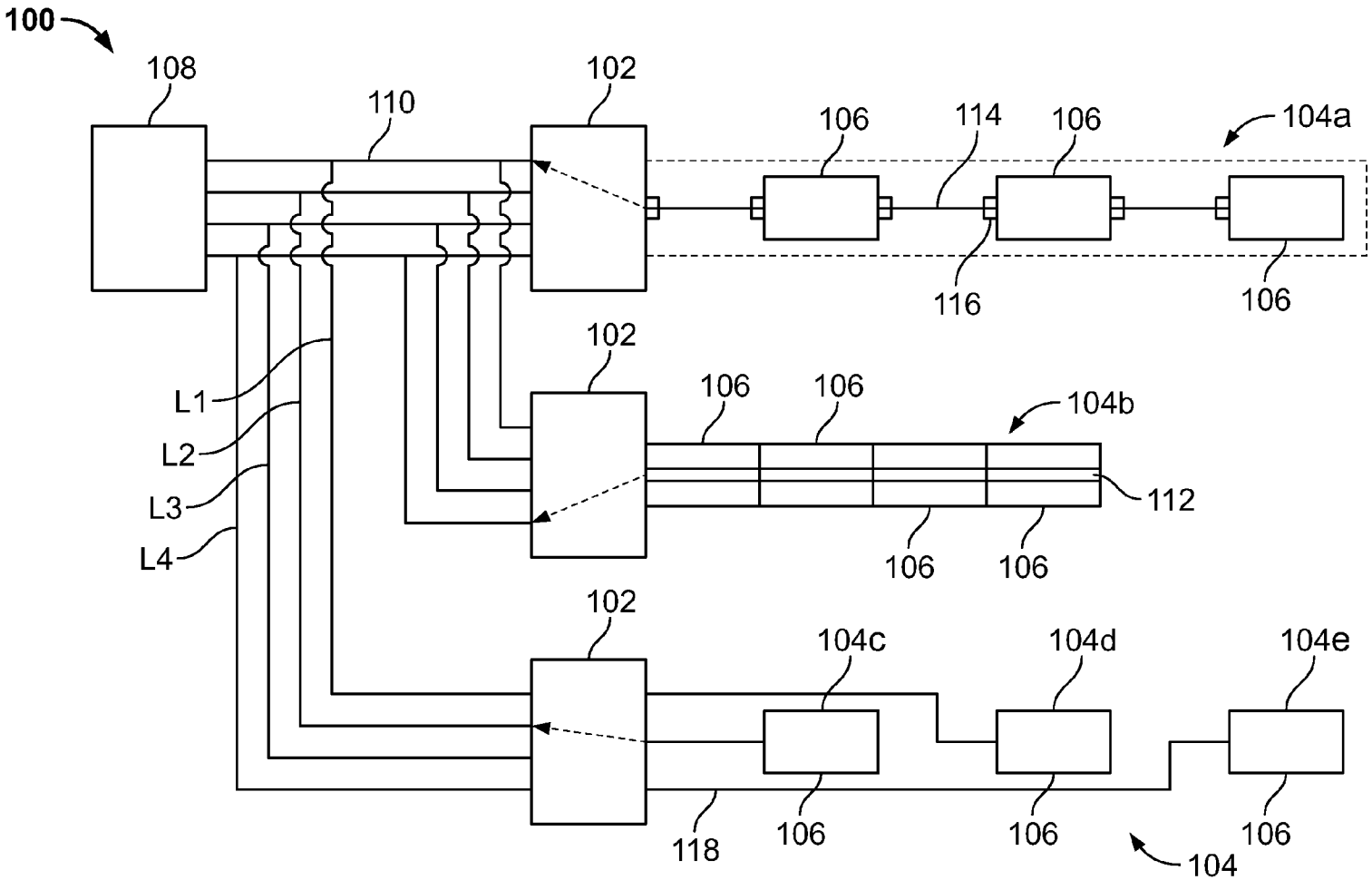
FIG. 1 is a schematic diagram of a power distribution system utilizing power control devices formed in accordance with an exemplary embodiment.

FIG. 1 is a schematic diagram of a power distribution system 100 utilizing power control devices 102 that are formed in accordance with an exemplary embodiment. The power control devices 102 are used to control the supply of power to power modules 104 that may include one or more end-use components 106. The power is supplied from a power source 108, such as a service entrance panel or circuit distribution panel. A plurality of line conductors 110 are connected between the power source 108 and the power control devices 102. In the illustrated embodiment, four line conductors 110 (L1, L2, L3 and L4) are utilized, however more or less line conductors may be used in alternative embodiments. Each of the line conductors 110 represent a different branch circuit that may be used to power the power modules 104.

In an exemplary embodiment, the line conductors 110 are distributed to, and electrically connected to, each of the power control devices 102. As such, each power control device 102 receives power from each branch circuit, or at least a plurality of the branch circuits. The power control devices 102 are electrically connected to at least one power module 104, and each power module 104 may include at least one device or component 106 that requires power to operate. For example, the power module 104*a* includes three electrical fixture ballasts that define the components 106 of the power module 104*a*. The power module 104*b* includes a power strip having four individual receptacles that define the components 106 of the power module 104*b*. Each of the power modules 104*c*, 104*d* and 104*e* includes a single electrical fixture ballast that defines a single component 106 for each power module 104*c*, 104*d*, 104*e*. Many other combinations of power control devices 102, power modules 104 and components 106 may be accommodated within the power distribution system 100, and the power distribution system 100 illustrated in FIG. 1 is provided for illustrative purposes only. The power modules 104 and the power control devices 102 may be integrated within a common housing or directly coupled to one another, as with the power module 104*b*, or alternatively, the power modules 104 may be in close proximity with the corresponding power control device 102, such as within the same room or area of a building.

Electrical connections between the power control device 102 and the power modules 104, or the components 106 within the power module 104, may be made in any known manner. For example, the connections may be made by using a bus bar 112, a wire harness, a power distribution cable 114 with connectors 116 on the ends that are mated to corresponding connectors on the power control device 102 and/or the power module 104, a power distribution cable 118 with individual wires that are directly terminated to a component within the power control device 102 and the power module 104, and the like.

The power control devices 102 operably connect the power modules 104 to selected ones of the branch circuits to provide power to the power modules 104. In an exemplary embodiment, the power control devices 102 define switches that may be utilized to create a path between the power modules 104 associated therewith and a select one of the branch circuits. For example, in the illustrated embodiment, the power module 104*a* is connected to the line conductor L1, the power module 104*b* is connected to the line conductor L4, and the power modules 104*c*, 104*d*, 104*e* are connected to the line conductor L2. However, the power control devices 102 may be switched to connect the power modules 104 associated therewith to any of the branch circuits to which the power control device 102 is connected. One exemplary use of such switching allows the power control devices 102 to balance loads on the branch circuits. For example, if all three power control devices 102 illustrated in FIG. 1 were connected to line conductor L1, and the line conductor L1 was overloaded, than at least one of the power control devices 102 could be switched to connect to a different one of the line conductors 110, such as line conductor L2.

Figure 2:
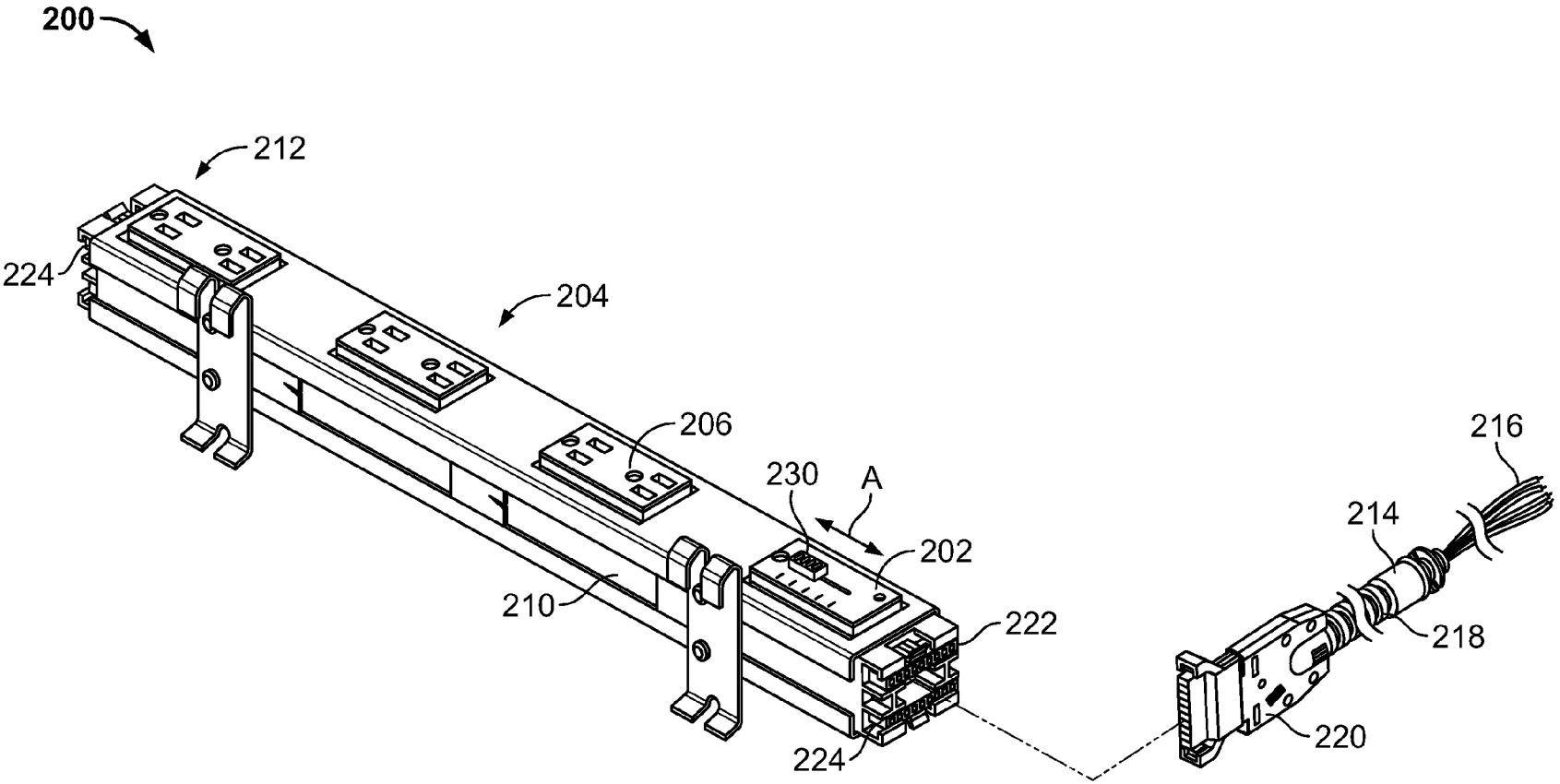
FIG. 2 illustrates a portion of an exemplary power distribution system utilizing a power control device formed in accordance with an exemplary embodiment.

FIG. 2 illustrates a portion of an exemplary power distribution system 200 utilizing a power control device 202 formed in accordance with an exemplary embodiment. The power distribution system 200 also includes a power module 204 having individual components 206, which in the illustrated embodiment define receptacle outlets, and may also be referred to hereinafter as receptacle outlets 206. The power control device 202 and the receptacle outlets 206 are each mounted within a common housing 210 to define a power strip 212. In an exemplary embodiment, the receptacle outlets 206 define duplex receptacle outlets suitable for receiving conventional three bladed fifteen ampere NEMA plugs, however other types of receptacle outlets may be provided, such as receptacle outlets for two bladed configurations, simplex receptacles, and the like. Optionally, all three receptacle outlets 206 may be connected to bus bars (not shown), similar to the bus bar 112 illustrated in FIG. 1, in a manner that is known. The hot line of the bus bar is powered by the power control device 202, in a manner that is described in further detail below. In an alternative embodiment, the power strip 212 may use individual wires to connect the receptacle outlets 206 to the line, neutral and/or ground.

The power strip 212 receives power from a power distribution cable 214 that includes a plurality of individual wires 216 contained within a cladding 218. Optionally, the power distribution cable 214 may be an eight wire version including four separate line conductors, two neutral conductors and two ground conductors. However, other configurations are possible, such as a five wire version that would represent three line conductors. Optionally, the wires 216 may be 18 gauge wires. A mating connector 220 is provided at an end of the power distribution cable 214 and the mating connector 220 is configured to be connected to a corresponding electrical connector 222 of the power strip 212. Optionally, the electrical connector 222 may be part of the power control device 202. In the illustrated embodiment, the power strip 212 includes at least one additional electrical connector 224 that may receive a different power distribution cable (not shown) to distribute power from the power strip 212 to another power strip, such as a power strip similar to the power strip 212 but that does not include a power control device. As such, the power strip 212 may operate as a master power strip, and any other power strip connected to the power strip 212 may operate as a slave power strip that is operated on the same branch circuit as the power strip 212. In one embodiment, at least some of the additional electrical connectors 224 may distribute power from each of the branch circuits coming into the power strip 212 to a second master power strip (not shown) having its own power control device, such that the second master power strip may select the branch circuit to which the second master power strip would be connected.

In an exemplary embodiment, the power control device 202 includes a movable switch 230 operable to create a path between the receptacle outlets 206 of the power module 204 and a select one of the branch circuits. In the illustrated embodiment, the switch 230 is a slider switch that may be moved along an axis 232 in the direction of arrow A. The switch 230 is movable between multiple positions for selecting different ones of the branch circuits. The power module 204 may thus be connected to any one of the branch circuits depending on the position of the switch 230. Additionally, the power control device 202 may include an OFF position, in which the power control device 202 is in a non-conducting state and is not connected to any of the branch circuits. The receptacle outlets 206 are not powered when the switch 230 is in the OFF position. The power control device 202 may include a safety feature configured to keep the power control device 202 in the non-conducting state. Optionally, the safety feature may be a disconnect, such as a portion of the switch 230 that is removable from the power control device 202 so that the switch 230 cannot be rotated to a conducting state. The safety feature may be a locking feature, such as a rotating latch, a catch wire, a keyed lock and the like, that is configured to retain the switch 230 in the non-conducting position.

Figure 3:
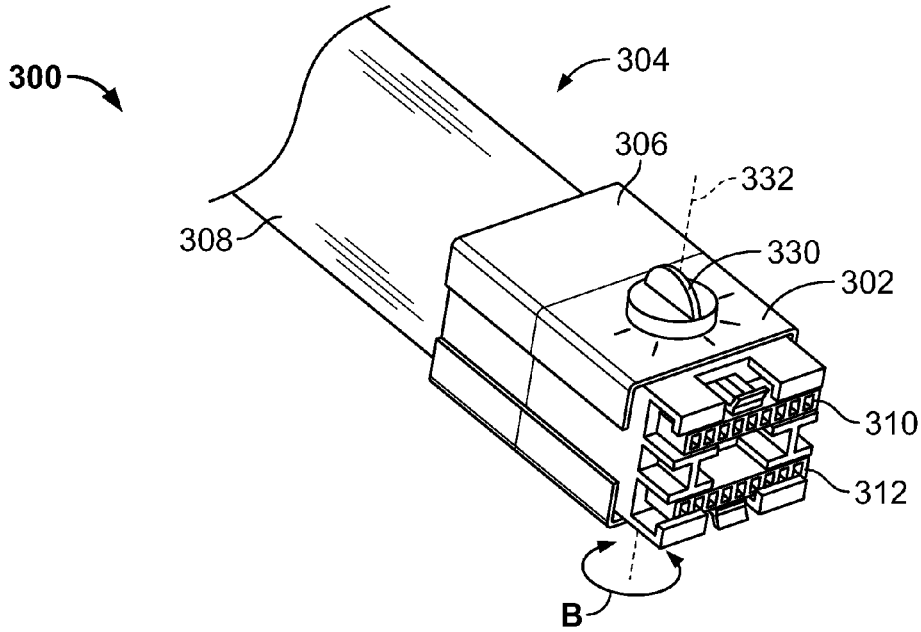
FIG. 3 illustrates a portion of an alternative power distribution system utilizing an alternative power control device formed in accordance with an alternative embodiment.

FIG. 3 illustrates a portion of an alternative power distribution system 300 utilizing an alternative power control device 302 formed in accordance with an alternative embodiment. The power distribution system 300 includes a power module 304 having an individual component 306, which in the illustrated embodiment defines an electrical lighting ballast, and may also be referred to hereinafter as ballast 306. The ballast 306 is used to light a fluorescent bulb 308. The power control device 302 and the ballast 306 are coupled to one another.

The power control device 302 receives power from a power distribution cable (not shown) that is similar to the power distribution cable 214 (shown in FIG. 2). The power control device 302 includes a first electrical connector 310 for receiving the power distribution cable. A second electrical connector 312 is also provided for receiving a second power distribution cable (not shown) that is used to connect to another power module (e.g. a ballast). In an exemplary embodiment, electrical paths are created between the first electrical connector 310 and the second electrical connector 312 such that each branch circuit may be passed through to the second electrical connector 312 and the second power module. As such, individual control may be passed to successive power modules. Alternatively, the successive power modules may be slave modules that are controlled by the power control device 302.

In an exemplary embodiment, the power control device 302 includes a movable switch 330 operable to create a path between the ballast 306 of the power module 304 and a select one of the branch circuits. In the illustrated embodiment, the switch 330 is a rotatable switch that may be rotated about an axis 332 in the direction of arrow B. The switch 330 is movable between multiple positions for selecting different ones of the branch circuits. The power module 304 may thus be connected to any one of the branch circuits depending on the position of the switch 330. Additionally, the power control device 302 may include an OFF position, in which the power control device 302 is in a non-conducting state and is not connected to any of the branch circuits. The ballast 306 is not powered when the switch 330 is in the OFF position. The power control device 302 may include a safety feature configured to keep the power control device 302 in the non-conducting state.

Figure 4:
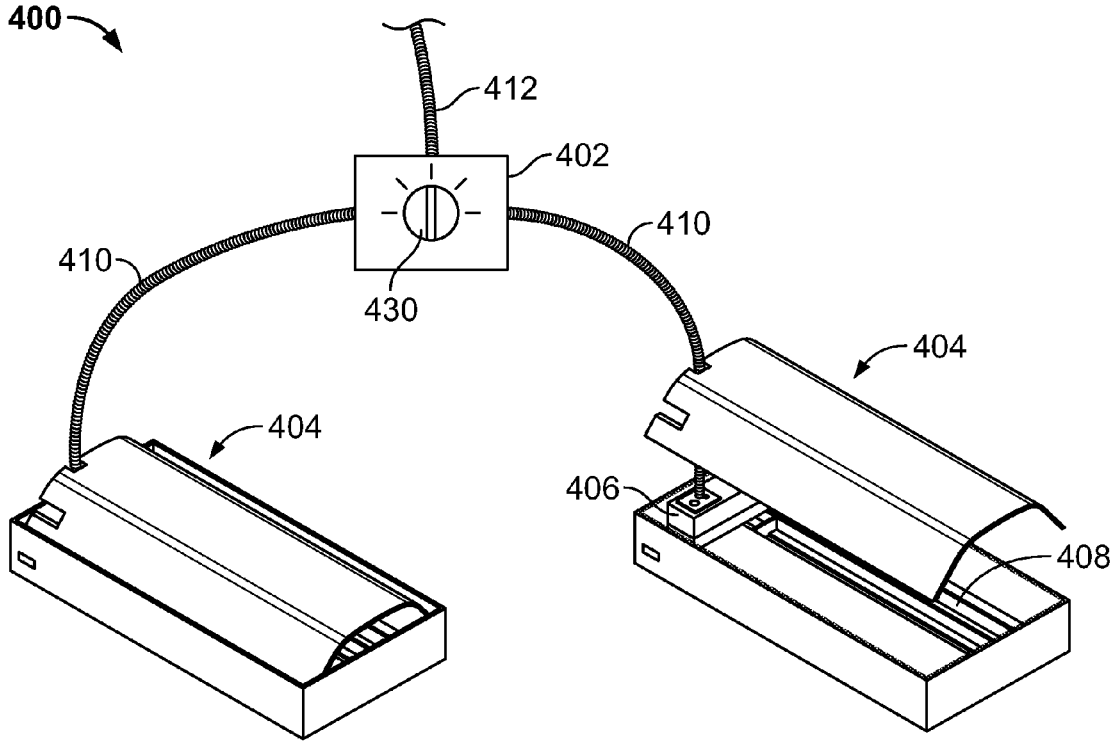
FIG. 4 illustrates another power distribution system utilizing an alternative power control device.

FIG. 4 illustrates another alternative embodiment of the power distribution system 400. The power distribution system 400 includes a power control device 402 and two power modules 404. More or less power modules 404 may be coupled to the power control device 402 in alternative embodiments. In the illustrated embodiment, the power modules 404 represent lighting fixtures. Each lighting fixture has an individual component 406, which in the illustrated embodiment defines an electrical lighting ballast, and may also be referred to hereinafter as ballast 406. The ballasts 406 are used to light fluorescent bulbs 408.

The power control device 402 and the ballasts 406 are located remote from one another, but in close proximity. Power distribution cables 410 interconnect the ballasts 406 with the power control device 402. In the illustrated embodiment, the power distribution cables 410 are hard wired to the power control device 402, however, connectors on the power control device 402, ballasts 406 and/or cables 410 may be used in alternative embodiments. The power control device 402 receives power from a power distribution cable 412.

In an exemplary embodiment, the power control device 402 includes a movable switch 430 operable to create a path between the ballasts 406 of the power modules 404 and a select one of the branch circuits. In the illustrated embodiment, the switch 430 is a rotatable switch. The switch 430 is movable between multiple positions for selecting different ones of the branch circuits. The power module 404 may thus be connected to any one of the branch circuits depending on the position of the switch 430. Additionally, the power control device 402 may include an OFF position, in which the power control device 402 is in a non-conducting state and is not connected to any of the branch circuits. The ballasts 406 are not powered when the switch 430 is in the OFF position. The power control device 402 may include a safety feature configured to keep the power control device 402 in the non-conducting state.

Figure 5:
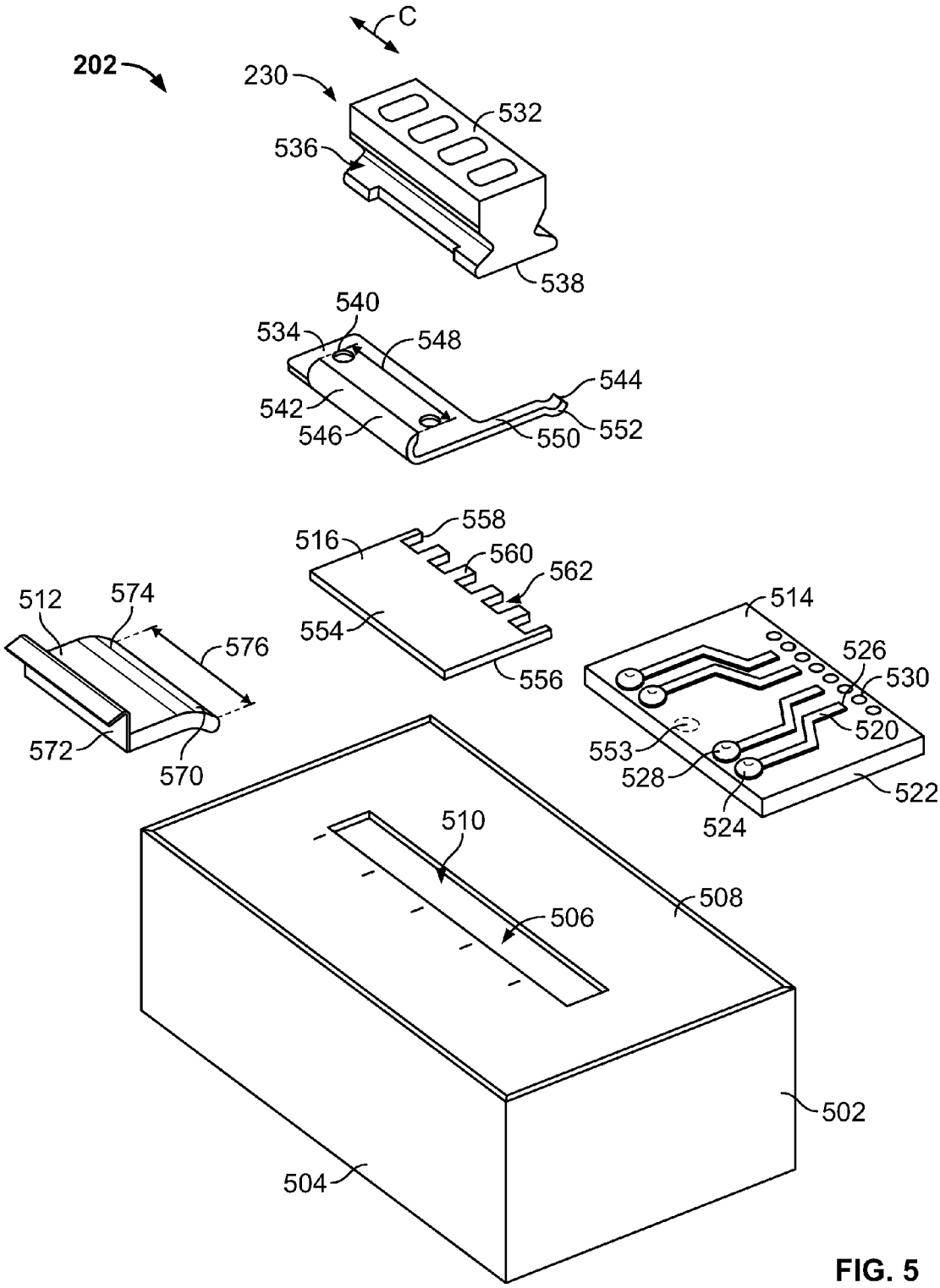
FIG. 5 is an exploded view of the power control device shown in FIG. 2.

FIG. 5 is an exploded view of the power control device 202 shown in FIG. 2. The power control device 202 includes a housing 502 having a plurality of walls 504 defining a chamber 506 and a cover 508 that covers the chamber 506. The cover 508 includes an opening 510 therethrough. The power control device 202 also includes the switch 230, a power contact 512, a distribution component 514, and an insulator 516 each of which are received within the housing 502. Optionally, the switch 230, power contact 512, distribution component 514 and/or insulator 516 may be held within designated pockets within the chamber 506 to position the components with respect to one another.

The distribution component 514 includes a plurality of separate line conductors 520 held by a substrate 522. The line conductors 520 are configured to receive power from different ones of the power supply branch circuits. In an exemplary embodiment, a leadframe is encased in a dielectric body to form the distribution component 514, wherein the conductors of the leadframe define the line conductors 520. Alternatively, the distribution component 514 may include a printed circuit board having traces thereon that define the line conductors 520. The line conductors 520 extend between a mating end 524 and a terminating end 526. The line conductors define a mating interface 528 proximate the mating end 524 for mating with the switch 230. Optionally, the distribution component 514 may include vias 530 for mating with contacts of the electrical connector 222 (shown in FIG. 2). Alternatively, the line conductors 520 may include pads, such as solder pads or contact pads, at the terminating ends 526 for direct mating with wires or contacts associated with the wires of the power distribution cable 214 (shown in FIG. 2) delivering power to the power control device 202.

The switch 230 includes a switch body 532 and a switch contact 534 that is coupled to the switch body 532. In the illustrated embodiment, the switch body 532 represents a button or slider that may be actuated, such as by a finger of an operator, to move between multiple positions. The positions may be identifiable by the operator by at least one of tactile, visual or audible indicators. The switch body 532 includes rails 536 along sides thereof. The rails 536 fit within the opening 510 in the cover 508 and guide the switch body 532 along the linear path of motion of the switch body 532, which is indicated by the arrow C. Other components may be utilized to guide the switch body 532 along the path of motion in alternative embodiments.

The switch contact 534 is coupled to the switch body 532 by pressing pins (not shown) on a bottom 538 of the switch body 532 through apertures 540 in the switch contact 534. Other means may be used in alternative embodiments to hold the switch contact 534 in position with respect to the switch body 532. The switch contact 534 includes a first mating end 542 that is configured to be electrically connected to the power contact 512 and a second mating end 544 that is configured to be electrically connected to the line conductors 520, more particularly, one of the mating interfaces 528. A power circuit or path is thus defined between the power contact and one of the branch circuits via the switch contact 534 and the line conductors 520.

In an exemplary embodiment, the switch contact 534 includes a first mating arm 546 that defines a mating interface for mating engagement with the power contact 512. The first mating arm 546 has a first length 548 selected to allow contact between the switch contact 534 and the power contact 512 along the entire range of motion of the switch 230. The switch contact 534 also includes a beam 550 that defines a mating interface for mating engagement with the line conductors 520. In the illustrated embodiment, the beam 550 extends from an opposite side of the switch contact 534 as the first mating arm 546. Optionally, the beam 550 may include a domed portion 552 proximate the distal end of the beam 550. The domed portion 552 is curved or radiused out of plane with respect to the beam 550. The domed portion 552 may be either concave or convex.

The switch contact 534 may be fabricated from a metallic material, such as a stainless steel material. Optionally, the switch contact 534 may be selectively plated, such as at the mating interfaces, to enhance electrical performance or other properties of the switch contact 534.

In an exemplary embodiment, the switch 230 may be moved to at least one position, namely an OFF position, in which the power control device 202 is in a non-conducting state. For example, the switch 230 may be moved to a position in which the beam 550 does not engage any of the line conductors 520. In the illustrated embodiment, when the beam 550 is aligned with an area 553, shown in phantom in FIG. 5, the beam 550 does not engage any line conductors 520, and thus, no power is conducted through the switch contact 534 to the power contact 512.

The insulator 516 is generally provided between the switch contact 534 and the distribution component 514. The insulator 516 is fabricated from a non-metallic material, such as a plastic laminate material. The insulator 516 includes a top surface 554 and a bottom surface 556. An edge 558 of the insulator 516 includes a plurality of fingers 560 that define spaces 562 therebetween. The spaces 562 are generally aligned with, and provide access to, the mating interfaces 528 of the line conductors 520. The beam 550 of the switch contact 534 fits in the spaces 562 such that the beam 550 may engage the line conductors 520 when properly positioned. In an alternative embodiment, rather than the fingers 560 defining the spaces 562, the spaces 562 may be openings through the insulator 516 that are aligned with the mating interfaces 528.

In operation, as the switch 230 is moved between positions, the beam 550 is transferred from being in contact with one of the line conductors 520 to being non-engaged with the line conductor 520, but rather resting upon one of the fingers 560. In an exemplary embodiment, the insulator 516 may be utilized to prevent arcing during separation of the switch contact 534 and the line conductor 520. The insulator 516 may be used to define an OFF position of the switch 230.

The power contact 512 includes a first mating end 570 that is configured to be electrically connected to the first mating end 542 of the switch contact 534 and a second mating end 572 that is configured to provide an electrical path to the power module 204 (shown in FIG. 2). The first mating end 570 includes a second mating arm 574 that defines a mating interface for mating with the first mating arm 546 of the switch contact 534. During operation, as the switch 230 is moved between the various positions, the first and second mating arms 546, 574 slidably engage one another, and maintain contact in each of the positions. Optionally, the first and second mating arms 546, 574 may break contact during the transition, but then re-engage once the switch 230 is properly positioned. The second mating arm 574 has a second length 576 selected to allow contact between the switch contact 534 and the power contact 512 along the entire range of motion of the switch 230.

Figure 6:
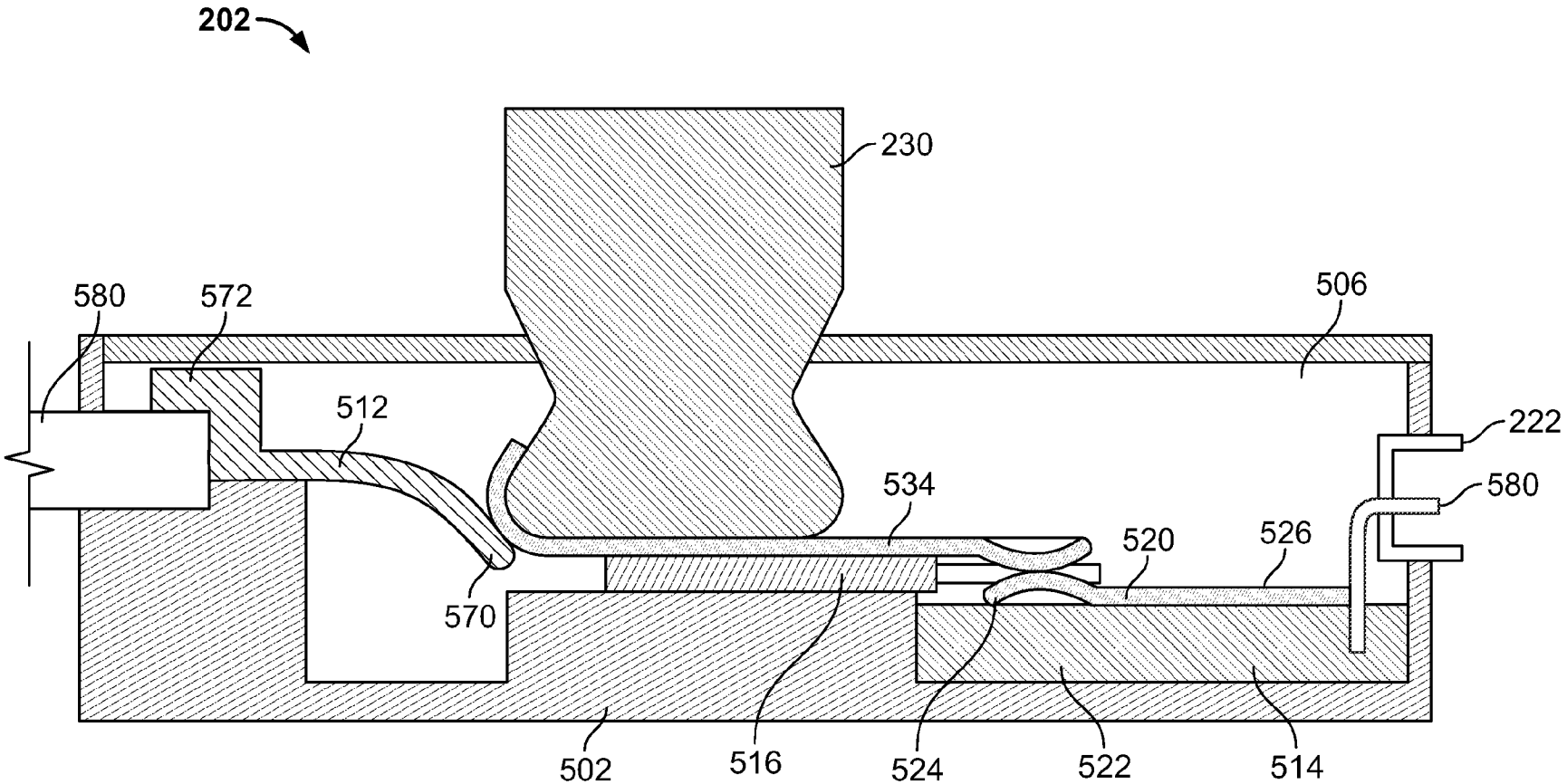
FIG. 6 is a cross sectional view of the power control device shown in FIG. 5.

FIG. 6 is a cross sectional view of the power control device 202. The switch 230, power contact 512, distribution component 514 and insulator 516 are held within the chamber 506 of the housing 502. The electrical connector 222 is presented at a side of the housing 502 for receiving the mating connector 220 (shown in FIG. 2). Contacts 580 of the electrical connector 222 extend into the housing 502 and are connected to the distribution component 514. The power supplied from each of the branch circuits are routed to the distribution component 514 by the contacts 580. The line conductors 520 of the distribution component 514 are electrically connected to respective ones of the contacts 580, such as by a direct connection or by routing traces along the substrate 522 to connect the contacts 580 with the line conductors 520. In alternative embodiments, wires within the power distribution cable 214 may be directly connected to the line conductors 520 or pads on the substrate 522. In other alternative embodiments, the terminating end 526 of the line conductors 520 may be directly terminated to the power distribution cable 214. For example, the line conductors 520 may be connected to the wires, such as by an insulation displacement contact portion at the terminating end 526, or the line conductors 520 may be connected to contacts of the power distribution cable 214, such as by having a mating contact formed at the terminating end 526.

At the mating end 524, the line conductors 520 are domed, such that the mating end 524 is out of plane with respect to the line conductor 520. The domed portion facilitates mating with the switch contact 534, which may also be domed. In the illustrated embodiment, the mating end 524 and the switch contact 534 are domed in opposite directions such that the apex of each dome engages one another. In alternative embodiments, the mating end 524 and the switch contact 534 may be domed in the same direction such that either the mating end 524 or the switch contact 534 is nested within the other.

The power contact 512 is held within the housing 502 and is configured to engage the switch contact 534 at the first mating end 570. The second mating end 572 that is configured to provide an electrical path to the power module 204. In the illustrated embodiment, the second mating end 572 of the power contact 512 is electrically connected to a bus bar 580. The bus bar 580 defines a hot line when the switch 230 is in a conducting state and distributes the power from one of the branch circuits to the receptacle outlets 206 (shown in FIG. 2). Other means and methods may be used to distribute the power from the power contact 512 to the receptacle outlets 206. For example, the power contact 512 may be connected to a printed circuit board. The printed circuit board may remain within the housing 502 and provide a connection interface to an electrical connector that would be presented at the side of the housing 502, or alternatively wires or contacts from the power modules 204 may be directly connected to the printed circuit board within the housing 502. In other alternative embodiments, the printed circuit board may extend out of the housing 502, and be oriented in close proximity to the receptacle outlets 206 for connection thereto. In other embodiments, a wire harness may be used to interconnect the receptacle outlets 206 with the power contact 512.

Figure 7:
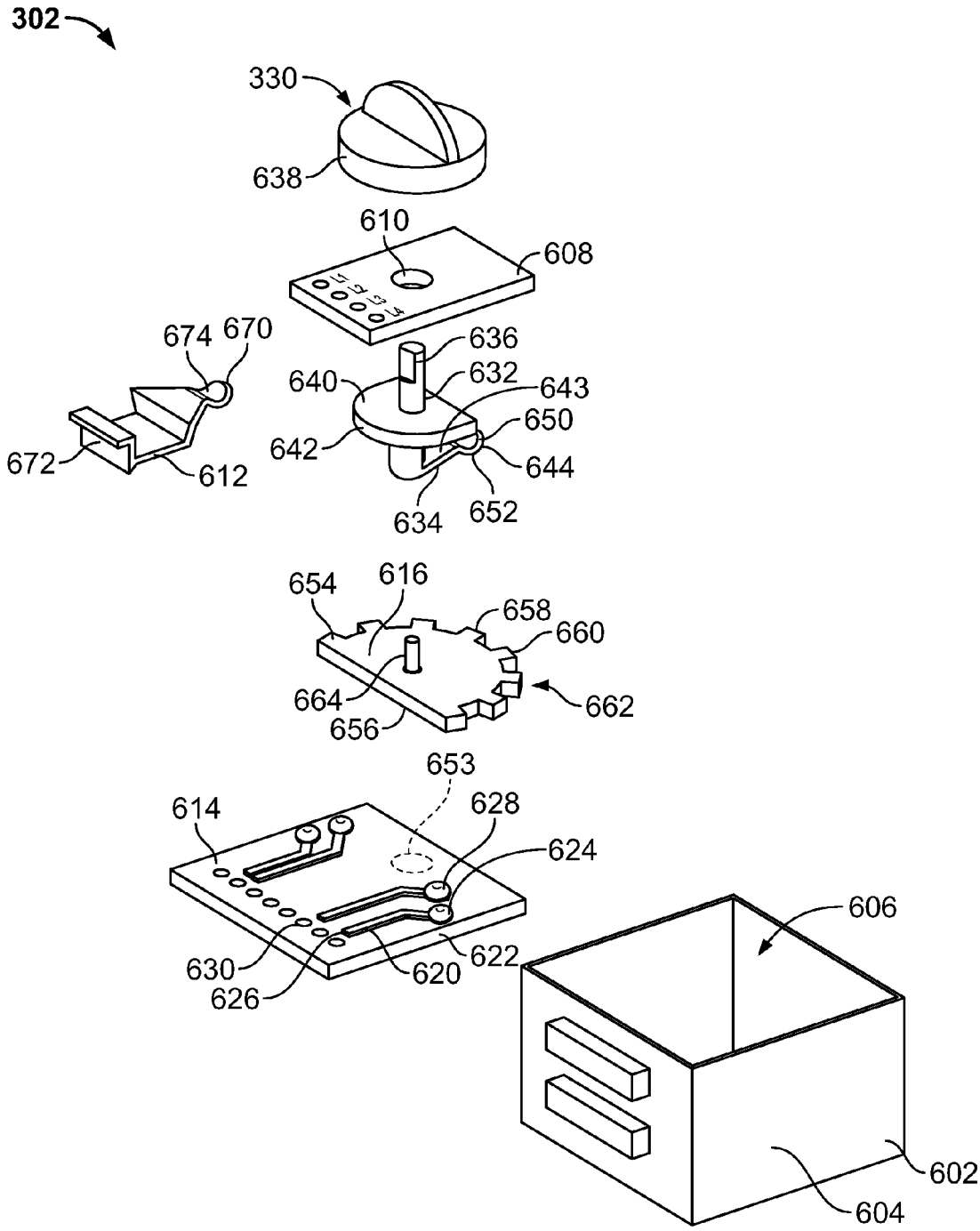
FIG. 7 is an exploded view of the power control device shown in FIG. 3.

FIG. 7 is an exploded view of the power control device 302 shown in FIG. 3. The power control device 302 includes a housing 602 having a plurality of walls 604 defining a chamber 606 and a cover 608. The cover 608 includes an opening 610 therethrough. The power control device 302 also includes the switch 330, a power contact 612, a distribution component 614, and an insulator 616 each of which are received within the housing 602.

The distribution component 614 includes a plurality of separate line conductors 620 held by a substrate 622. The line conductors 620 are configured to receive power from different ones of the power supply branch circuits. The line conductors 620 extend between a mating end 624 and a terminating end 626. The line conductors 620 define a mating interface 628 proximate the mating end 624 for mating with the switch 330. Optionally, the distribution component 614 may include vias 630 for mating with the electrical connector 310.

The switch 330 includes a switch body 632 and a switch contact 634 that is coupled to the switch body 632. In the illustrated embodiment, the switch body 632 represents a knob or dial that may be rotated to move between multiple positions. The switch body 632 includes a shaft 636 and a head 638. The shaft 636 and/or the head 638 extends through the opening 610 and is accessible on the exterior of the housing 602. Optionally, the head 638 may be removably coupled to the shaft 636. The head 638 may be removed from the shaft 636 as a safety feature, whereby when the head 638 is removed, the switch 330 can not be rotated to a different position. Thus, an operator may remove the head 638, such as when the switch 330 is in an OFF position or a non-conducting position, when the operator is repairing or replacing part of the power module 304 (shown in FIG. 3). Optionally, the head 638 may only be removed when the switch 330 is in the OFF position. Additionally, in some embodiments, the head 638 may be removed by depressing a release button or by using a tool. Other types of safety features may be provided in alternative embodiments.

The switch contact 634 includes a first mating portion 640 having a first mating end 642 that is configured to be electrically connected to the power contact 612. The switch contact 634 also includes a second mating portion 643 having a second mating end 644 that is configured to be electrically connected to the line conductors 620, more particularly, one of the mating interfaces 628. A power circuit is thus defined between the power contact 612 and one of the branch circuits via the switch contact 634 and the line conductors 620. In an exemplary embodiment, the first mating portion 640 defines a pad that has a mating interface for mating engagement with the power contact 612. The first mating portion 640 is sized and shaped to allow contact between the switch contact 634 and the power contact 612 along the entire range of motion of the switch 330. For example, the first mating portion 640 is curved such that, as the switch 330 is rotated, the first mating portion 640 is aligned with the power contact 612.

The second mating portion 643 includes a beam 650 that defines a mating interface for mating engagement with the line conductors 620. Optionally, the beam 650 may include a domed portion 652 proximate the distal end of the beam 650. The domed portion 652 is curved or radiused out of plane with respect to the beam 650. The domed portion 652 may be either concave or convex.

Optionally, the first and second mating portions 640, 643 may be integrally formed. Alternatively, the first and second mating portions 640, 643 may be separately fabricated and electrically connected to one another. For example, the first mating portion 640 may include a dielectric substrate that is selectively plated to define an electrical path between the mating interface for the power contact 612 and the second mating portion 643.

In an exemplary embodiment, the switch 330 may be moved to at least one position in which the power control device 302 is in a non-conducting state. For example, the switch 330 may be moved to a position in which the beam 650 does not engage any of the line conductors 620. In the illustrated embodiment, when the beam 650 is aligned with an area 653, shown in phantom in FIG. 6, the beam 650 does not engage any line conductors 620, and thus, no power is conducted through the switch contact 634 to the power contact 612.

The insulator 616 is generally provided between the switch contact 634 and the distribution component 614. The insulator electrically isolates the switch contact 634 and the distribution component 614 in a controlled manner by allowing the switch contact 634 to engage the line conductors 620 when the switch 330 is positioned at certain positions. The insulator 616 includes a top surface 654 and a bottom surface 656. An edge 658 of the insulator 616 includes a plurality of fingers 660 that define spaces 662 therebetween. In an exemplary embodiment, the edge 658 is curved. The spaces 662 are generally aligned with, and provide access to, the mating interfaces 628 of the line conductors 620. In an exemplary embodiment, the fingers 660 extend generally radially outward and the spaces 662 are provided along an arced path. The beam 650 of the switch contact 634 fits in the spaces 662 such that the beam 650 may engage the line conductors 620 when properly positioned. The insulator 616 is fabricated from a non-metallic material, such as a plastic laminate material. The insulator 616 includes a pin 664 extending from the top surface 654 thereof. The shaft 636 receives the pin 664, which operates to hold the shaft 636 such that the shaft 636 may be rotated about the pin 664. In an exemplary embodiment, the insulator 616 may be utilized to prevent arcing during separation of the switch contact 634 and the line conductor 620 as the switch 330 is rotated.

The power contact 612 includes a first mating end 670 that is configured to be electrically connected to the first mating end 642 of the switch contact 634 and a second mating end 672 that is configured to provide an electrical path to the power module 304 (shown in FIG. 3). The first mating end 670 includes a mating arm 674 that defines a mating interface for mating with the first mating portion 640 of the switch contact 634. During operation, as the switch 330 is moved between the various positions, the mating arm 674 slides along the surface of the first mating portion 640, and maintains contact in each of the positions. The power contact 612 is electrically connected to the ballast 306 (shown in FIG. 3) either directly, such as by a bus bar, a contact of the ballast, or a wire of the ballast, or indirectly, such as by a circuit board that interconnects the power contact 612 and a contact or wire of the ballast 306. As such, an electrical path may be created between the ballast 306 and a selected one of the branch circuits via the power contact 612, the switch contact 634, and the distribution component 614.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A power distribution system having a plurality of circuits each configured to supply power, the power distribution system comprising:

a plurality of power modules;

a first power control device connected to each of the circuits and configured to supply power to a first sub-set of the power modules from a first of the circuits; and a second power control device connected to each of the circuits and configured to supply power to a second sub-set of the power modules that is different than the first sub-set of power modules, the second power control device is configured to supply power from a second of the circuits.

2. The system of claim 1, wherein the first power control device includes a first switch operable to create a first path between the first sub-set of power modules and the first circuit, and the second power control device includes a second switch operable to create a second path between the second sub-set of power modules and the second circuit.

3. The system of claim 1, wherein the first power control device includes a plurality of line conductors and a switch mated with a first of the line conductors associated with the first circuit, wherein the switch is movable between multiple positions for mating with different ones of the line conductors so that the first sub-set of power modules can be connected to any one of the circuits depending on the position of the switch.

4. The system of claim 1, further comprising a third power control device connected to each of the circuits and configured to supply power to a third sub-set of the power modules, the third power control device being selectively connectable to either the first circuit or the second circuit depending on the load on the respective first and second circuits from the first and second power control devices to balance loads on the first and second circuits.

5. The system of claim 1, wherein the first power control device is directly coupled to at least one of the power modules within the first sub-set of power modules.

6. The system of claim 1, wherein the first power control device includes a first electrical connector and a second electrical connector, the first electrical connector receives a mating connector of a power distribution cable connected to the power supply, and the second electrical connector receives a mating connector of a power distribution cable connected to one of the power modules of the first sub-set of power modules.

7. The system of claim 1, wherein the first power control device includes a bus bar configured to supply power to the first sub-set of power modules.

8. The system of claim 1, wherein the power modules define one of a power receptacle and a ballast.

9. A power control device for a power distribution system comprising:

a housing;

a power contact held within the housing;

a distribution component having a plurality of separate line conductors, each line conductor configured to receive power from a different power supply circuit, each line conductor having a mating interface; and a movable switch having a switch contact coupled thereto, the switch contact having a first mating end electrically connected to the power contact and a second mating end selectably connected to the mating interface of one of the line conductors to define a power circuit between the power contact and one of the line conductors.

10. The device of claim 9, wherein the switch is slidable along an axis between a first position, a second position and a third position, wherein the switch contact engages a first line conductor in the first position, the switch contact engages a second line conductor in the second position, and the switch contact does not engage any line conductor in the third position.

11. The device of claim 9, wherein the switch is movable between multiple positions such that the switch contact engages different line conductors in each position and the switch contact engages the power contact in each position.

12. The device of claim 9, wherein the switch is rotatable about an axis between a first position, a second position and a third position, wherein the switch contact engages a first line conductor in the first position, the switch contact engages a second line conductor in the second position, and the switch contact does not engage any line conductor in the third position.

13. The device of claim 9, wherein the switch contact has a beam and a domed portion at the second mating end, the domed portion engages the mating interface.

14. The device of claim 9, wherein the distribution component is one of a printed circuit board with traces defining the line conductors or a leadframe being held by a dielectric body.

15. The device of claim 9, further comprising an electrical connector electrically connected with the distribution component, the electrical component being configured to receive a mating connector of a power distribution cable.

16. The device of claim 9, further comprising an insulator positioned between the distribution component and the switch contact, the insulator providing access to the mating interfaces of each of the line conductors.

17. The device of claim 9, wherein the switch contact has a mating arm having a first length, the power contact has a mating arm engaging the mating arm of the switch contact and having a second length, the first and second lengths being selected such that the mating arms engage one another along an entire range of motion of the switch.

18. The device of claim 9, wherein the switch is movable to an off position in which power is not conducted to the power contact, the power control device having a safety feature configured to keep the power control device in the non-conducting state.

19. A power control device for a power distribution system comprising:

a housing;

a power contact held within the housing;

a distribution component having a plurality of separate line conductors, each line conductor configured to receive power from a different power supply circuit, each line conductor having a mating interface;

a movable switch having a switch contact coupled thereto, the switch contact having a first mating end electrically connected to the power contact, and the switch having a second mating end, the switch being movable between a non-conducting position and a plurality of conductive positions that are connected to the mating interface of certain ones of the line conductors; and a safety feature configured to keep the power control device in the non-conducting state.

20. The device of claim 19, wherein the safety feature is either a portion of the switch that is removable from the power control device or a locking feature that is configured to retain the switch in the non-conducting position.

* * * * *